United States Patent [19]

Hein

[11] Patent Number: 5,000,328

[45] Date of Patent: Mar. 19, 1991

[54] COAT HANGER

[76] Inventor: Michael Hein, 210 W. Poplar St., Haviland, Kans. 67059

[21] Appl. No.: 519,821

[22] Filed: May 7, 1990

[51] Int. Cl.[5] ..... A47F 5/00

[52] U.S. Cl. ..... 211/89; 211/32; 248/316.6

[58] Field of Search ..... 211/89.32, 100, 99, 211/170, 171; 248/316.3, 316.4, 316.5, 316.6

[56] References Cited

U.S. PATENT DOCUMENTS

| | | | |
|---|---|---|---|
| 370,959 | 10/1887 | Lotz | 211/32 |
| 380,602 | 4/1888 | Simmons et al. | 211/32 X |
| 1,540,803 | 6/1925 | Powers | 248/316.3 X |
| 2,002,566 | 5/1935 | Conigrave | 211/89 |
| 3,508,664 | 4/1970 | Lessard | 211/89 |

*Primary Examiner*—Robert W. Gibson, Jr.
*Attorney, Agent, or Firm*—Leon Gilden

[57] ABSTRACT

A coat hanger includes first and second jaws designed to grasp and hold a coat. The jaws are each pivotally attached to a supporting structure and a small metal rod is pivotally attached between the jaws. Through the use of the metal rod, an increased gripping force is achieved in proportion to an increased weight.

7 Claims, 3 Drawing Sheets

COAT HANGER

BACKGROUND OF THE INVENTION

1. Related Application

This application is related to application Ser. No. 07/001/415 filed Jan. 8, 1987 by the same inventor and entitled COAT HANGER.

2. Field of the Invention

The present invention relates to hangers, and more particularly pertains to a new and improved coat hanger construction which eliminates the need for spring-biased gripping means.

3. Description of the Prior Art

The use of coat hangers, and the like, which utilize gripping jaws normally held together by spring biasing means is well known in the prior art. For example, reference is made to U.S. Pat. No. 1,701,783, which issued to H. Law on Feb. 12, 1929. The support rack shown in this patent includes a main support member having a plurality of spring-biased clips attached thereto. Each clip may be manually opened against the resisting force of an associated spring so as to spread a pair of jaws to thus receive garment. The force of the springs then holds the jaws in gripping engagement with the chosen garment. This rack is illustrative of a far greater number of such racks now available in the art—all of which utilize spring-biasing means to achieve a garment gripping relationship between opposed jaws.

Other patents of interest which illustrate gripping jaws utilizing spring-biasing means include U.S. Pat. Des. No. 82,948, which issued to S. Livingston on Dec. 30, 1930, and U.S. Pat. No. 84,883, which issued to J. De George on Aug. 18, 1931. As can be appreciated, all of these prior art patents require special manufacturing and assembly processes due to the use of associated springs. Further, these springs are subject to breakage over an extended period of use, while they also tend to lose their holding ability as a function of time and usage. As such, there appears to be a continuing need for new and improved garment holders which utilize gripping jaws that do not lose their gripping capacity as a function of spring wear or breakage. In this respect, the present invention substantially fulfills this need.

SUMMARY OF THE INVENTION

In view of the foregoing disadvantages inherent in the known types of garment hangers now present in the prior art, the present invention provides an improved garment hanger construction wherein the same utilizes gripping jaws which do not obtain their gripping force through the use of spring-biasing means. As such, the general purpose of the present invention, which will be described subsequently in greater detail, is to provide a new and improved garment hanger which has all the advantages of the prior art garment hangers and none of the disadvantages.

To attain this, the present invention comprises a first gripping jaw pivotally mounted to a support structure and a second gripping jaw pivotally mounted to such structure and being abuttable with the first jaw. Additionally, a small metal rod is pivotally attached between the jaws in an angulated relationship thereto. In this regard, the rod is pivotally mounted within slots formed in the abutting faces of each of the jaws. When in a normal hanging position, the jaws are in abutment with each other. When lifted, however, the steel rod causes the jaws to become spaced apart so as to receive a garment, such as a coat or the like. The weight of the garment will pull the jaws downwardly again so as to cause them to achieve a gripping relationship with the garment. A greater gripping force is achieved in response to a greater garment weight.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved garment holder which has all the advantages of the prior art garment holders and none of the disadvantages.

It is another object of the present invention to provide a new and improved garment holder which may be easily and efficiently manufactured and marketed.

It is a further object of the present invention to provide a new and improved garment holder which is of a durable and reliable construction.

An even further object of the present invention is to provide a new and improved garment holder which is susceptible of a low cost of manufacture with regard to both materials and labor, and which accordingly is then susceptible of low prices of sale to the consuming public, thereby making such garment holders economically available to the buying public.

Still yet another object of the present invention is to provide a new and improved garment holder which provides in the apparatuses and methods of the prior art some of the advantages thereof, while simultaneously overcoming some of the disadvantages normally associated therewith.

Still another object of the present invention is to provide a new and improved garment holder which utilizes gripping jaws not requiring spring-biasing means.

Yet another object of the present invention is to provide a new and improved garment holder which includes the use of gripping jaws that achieve a greater gripping force in response to a greater hanging weight.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
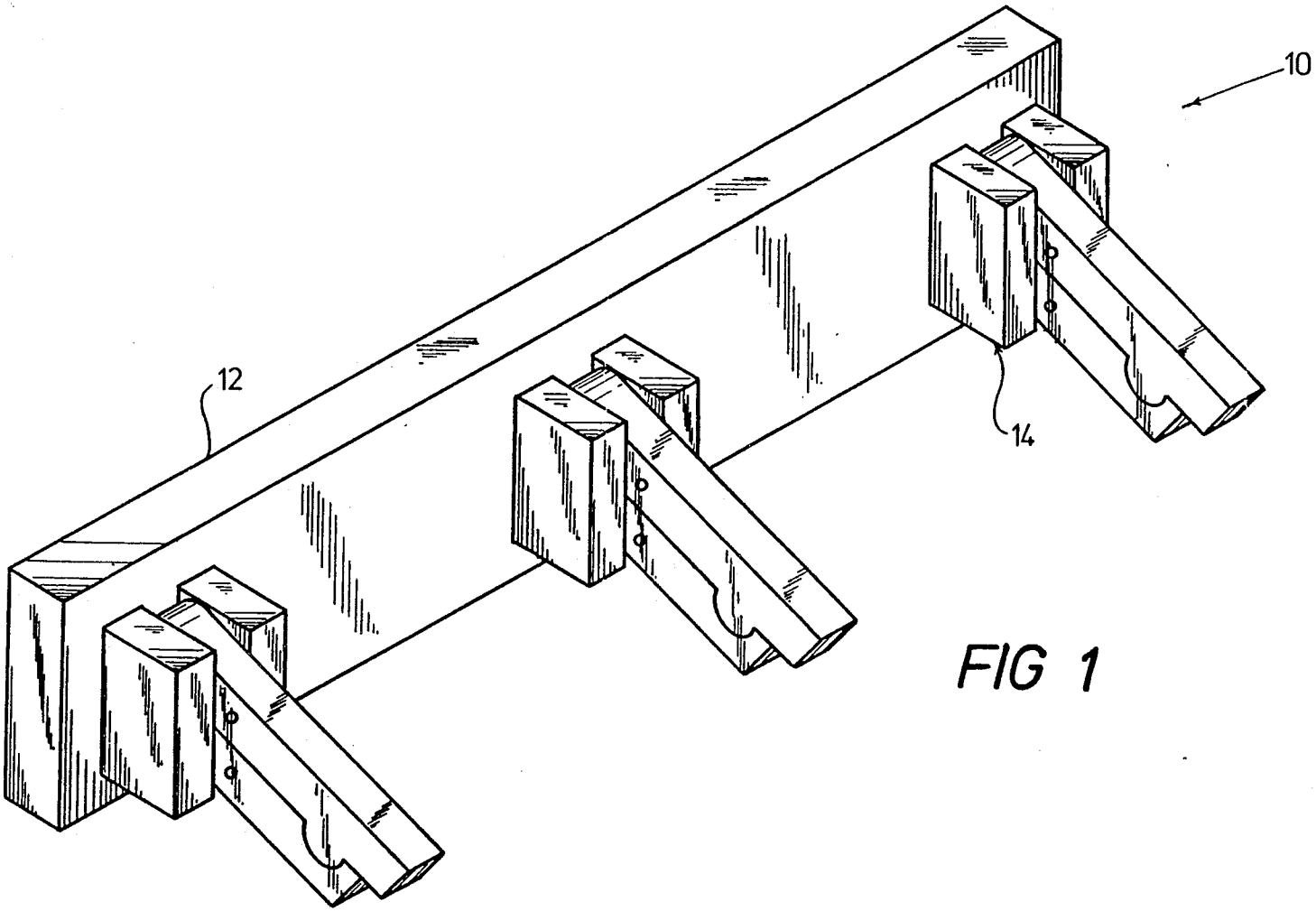
FIG. 1 is a perspective view of a coat hanger assembly comprising the present invention.

With reference now to the drawings, and in particular to FIG. 1 thereof, a new and improved garment holder embodying the principles and concepts of the present invention and generally designated by the reference numeral 10 will be described.

More specifically, it will be noted that the garment holder 10 may typically include a support member 12 to which a plurality of clamp assemblies 14 may be attached. The support structure 12 is illustrated as being of an elongated design, and would typically be constructed of wood, or some similar material. Each of the garment gripping devices 14 are independently operable, and it is to be understood that they could be used independently from the support structure 12. As such, it is within the intent and purview of the present invention to use the garment gripper 14 either singly or in combination with a plurality of other garment grippers which are attached to a support member 12.

Figure 2:
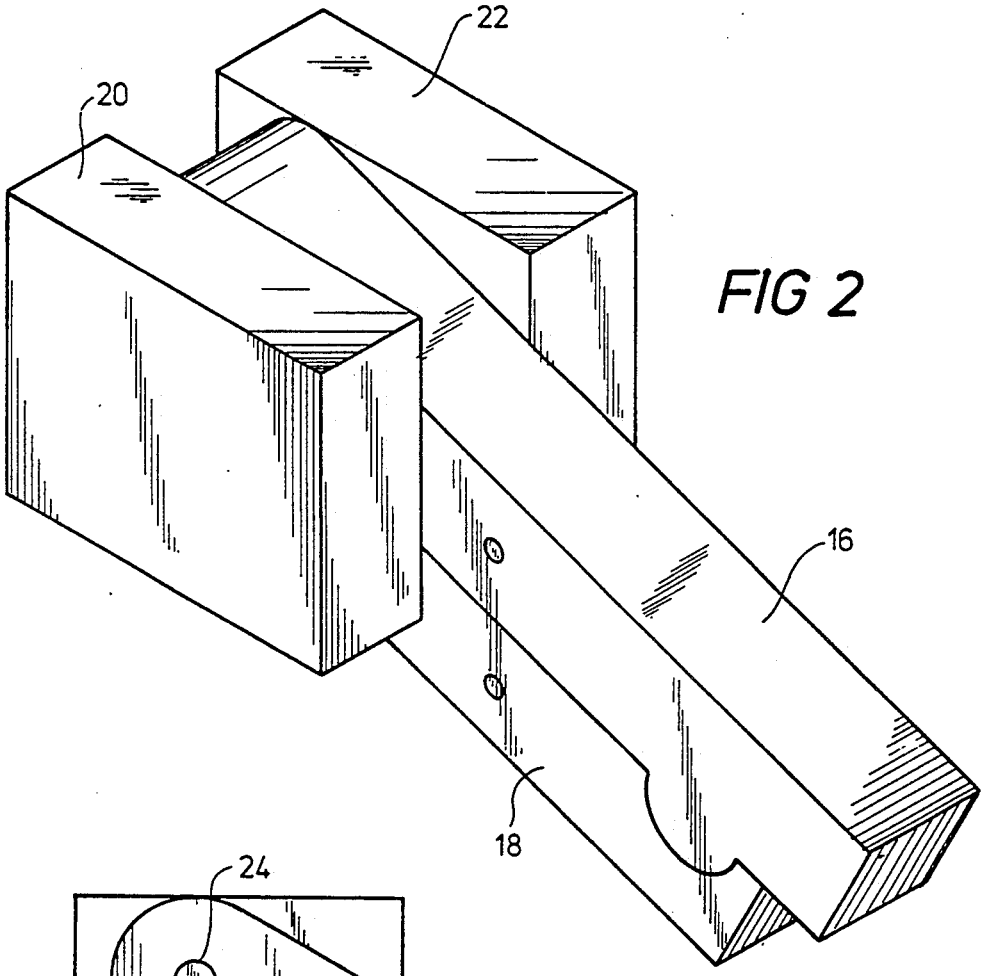
FIG. 2 is a perspective view of one of the gripping jaw assemblies forming a part of the present invention.
Figure 3:
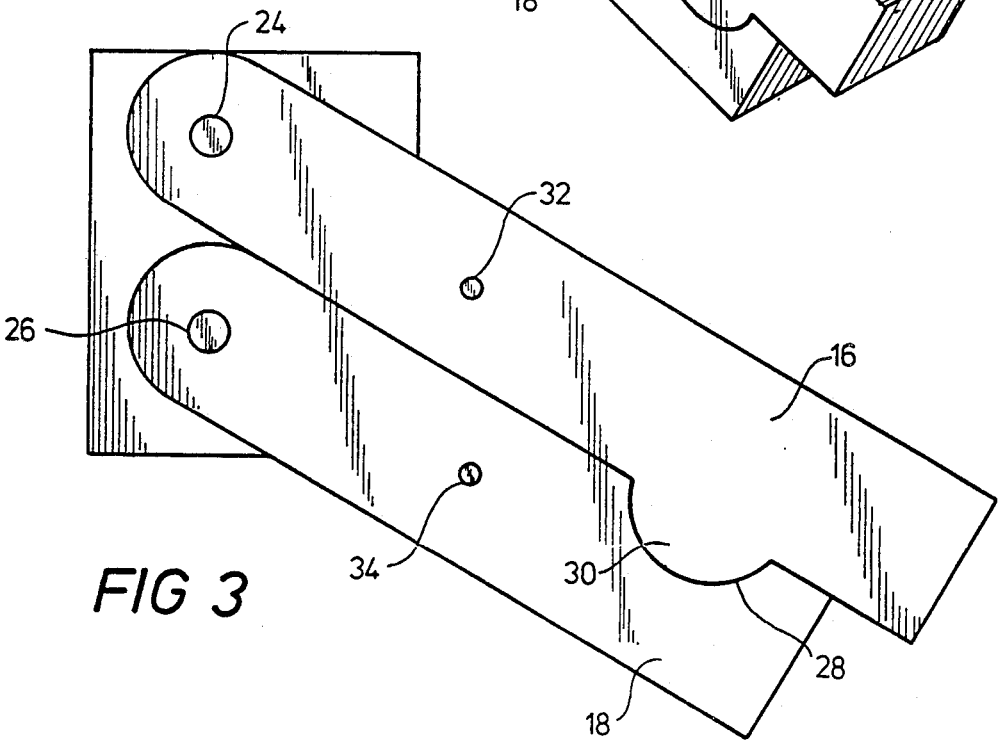
FIG. 3 is a side elevation view of the invention showing the same partially disassembled.

With respect to the construction of the individual garment gripping devices 14, reference is made to FIGS. 2 and 3 in conjunction with FIG. 1. More particularly, it can be seen that each garment gripping device 14 essentially includes an upper jaw member 16 and a lower jaw member 18 abuttable therewith. The gripping jaws 16, 18 are pivotally mounted between a pair of support blocks 20, 22. The support blocks 20, 22 will ideally be constructed from wood, as would the gripping jaws 16, 18, and metal rods 24, 26 are utilized to effect the pivotal attachment of the respective jaws 16, 18 between the support blocks. In this regard, the jaw 16 is pivotally movable around the rod 24, while the jaw 18 is pivotally movable around the support rod 26.

With further reference to FIGS. 1, 2 and 3 of the drawings, it will be observed that the lower jaw 18 includes a concave depression which is designed to receive a downwardly extending, convexly-shaped portion 30 of the upper jaw 16. The downwardly extending member 30 and the concave depression 28 serve as a gripping means to effect a retention of a garment between the jaws 16, 18. It is to be understood that any type of gripping surface formed between the jaws 16, 18 is within the conception of the present invention as long as a functional use of the invention is permitted, and the claims appended hereto reflect all such conceivable variations in jaw face design.

Figure 4:
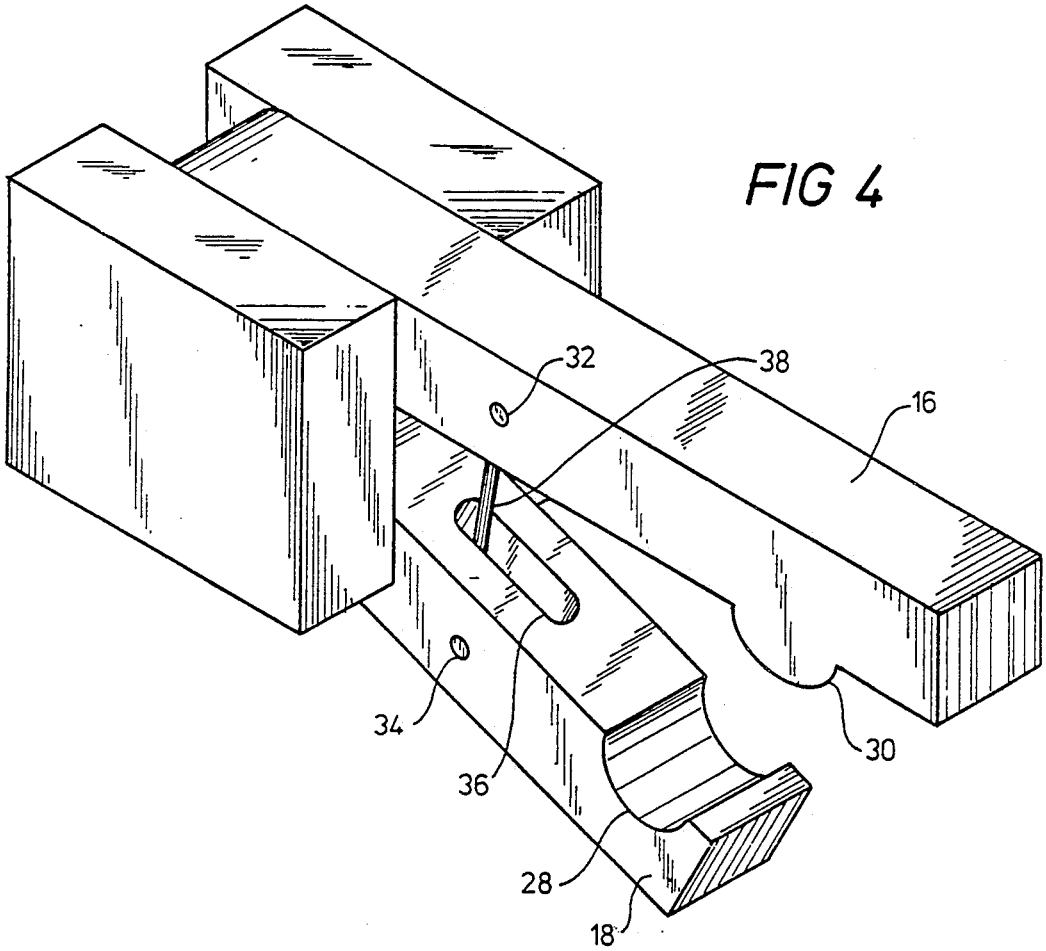
FIG. 4 is a perspective view of the invention illustrating an operation thereof.

With reference to FIG. 4 in conjunction with FIGS. 1, 2 and 3 of the drawings, it will be noted that a further pair of rods 32, 34 are directed through the respective jaws 16, 18. The rod 34 extends completely through the width of the jaw 18 and also passes through a slot 36 formed in the jaw. Similarly, the rod 32 passes through the complete width of the jaw 16 and also through an unillustrated slot formed in this jaw, with the unillustrated slot being substantially identical to the slot 36 formed in the jaw 18. Interconnected between and pivotally attached to the rods 32, 34 is a small metal rod 38. The rod 38 may include loops positionable around the rods 32, 34 so as to achieve a pivotal interconnection therebetween. As illustrated, the rod 38 is normally angulated with respect to the plane of the jaws 16, 18 when they are in abutment with each other, and moves towards an orthogonal relationship to the jaw member 16 when this jaw is lifted upwardly as best illustrated in FIG. 4. Inasmuch as the rod 38 moves towards a vertical relationship to the jaw 16, it effects a spaced-apart movement of the jaw 16 with respect to the jaw 18. As such, the jaws 16, 18 are forced apart to receive a garment when a manual lifting of the jaw 16 in an upward direction is achieved.

With a garment positioned between the jaws 16, 18, the jaw 16 may be released and the rod 38 will then guide the jaws back into an abutting relationship. Further, the greater the weight of the garment placed between the jaws 16, 18, the greater the gripping force achieved therebetween due to the guiding movement of the rod 38. As such, no spring-biasing means are required to retain the jaws 16, 18 in an abutting gripping relationship with a garment.

Figure 5:
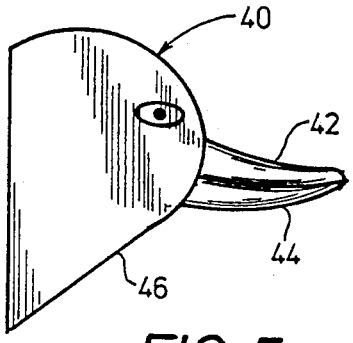
FIG. 5 is a modified embodiment of the invention illustrating a particular design thereof.

While FIGS. 1, 2, 3 and 4 illustrate a preferred embodiment of the invention, it is to be understood that various designs of the jaws 16, 18 and their supporting structure is within the intent and purview of the present invention. In this respect, reference is made to FIG. 5 of the drawings wherein the invention 10 has been redesigned to resemble the head of a duck 40. In this construction, an upper gripping jaw 34 is abutable with a lower gripping jaw 44, with the jaw being pivotally retained within a support structure 46. Of course, the use of a rod 38 pivotally interconnected between the jaws 42, 44 would be necessary, as would be the pivotal connection of the was with the support structure 46 in a manner similar to that illustrated with respect to the first embodiment of the invention.

With respect to the manner of usage and operation of the present invention, the same should be apparent from the above description. Accordingly, no further discussion relating to the manner of usage and operation of the invention will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A garment hanger, comprising:

a. garment gripping jaw means including first and second jaws for receiving and holding said garment;

b. support structure means for supporting said first and second jaws, said first and second jaws each being pivotally mounted to said support structure means;

c. jaw movement control means effecting a controlled spaced apart movement of said first and second jaws so as to facilitate said receiving and holding of said garment, said jaw movement control means comprising a rigid member being pivotally connected to a first through-extending pin positioned in said first jaw and being further pivotally connected to a second through-extending pin positioned in said second jaw.

2. The garment holder of claim 1, wherein said rigid member is positioned within first and second slots formed in respective abutting faces of said first and second jaws.

3. The garment holder of claim 2, wherein said first and second pins pass through said first and second slots.

4. The garment holder of claim 3, wherein said rigid member is angularly positioned with respect to a plane formed by an abutment of said first and second jaw.

5. The garment holder of claim 4, wherein said rigid member comprises a metallic rod.

6. The garment holder of claim 5, and further including a downwardly extending convexly-shaped gripping portion formed on a face of said first jaw.

7. The garment holder of claim 6, and further including a concavely-shaped receiving portion formed on a face of said second jaw, said convexly-shaped gripping portion being positioned within said concavely-shaped receiving portion.

* * * * *